US012414617B1

(12) United States Patent
Mainwaring

(10) Patent No.: US 12,414,617 B1
(45) Date of Patent: Sep. 16, 2025

(54) PORTABLE COSMETIC ACCESSORY

(71) Applicant: Fallon Gray Mainwaring, Fort Worth, TX (US)

(72) Inventor: Fallon Gray Mainwaring, Fort Worth, TX (US)

( * ) Notice: Subject to any disclaimer, the term of this patent is extended or adjusted under 35 U.S.C. 154(b) by 0 days.

(21) Appl. No.: 18/671,113

(22) Filed: May 22, 2024

(51) Int. Cl.
*A45D 34/06* (2006.01)

(52) U.S. Cl.
CPC ..... *A45D 34/06* (2013.01)

(58) Field of Classification Search
CPC ..... A45D 33/18; A45D 33/008; A45D 33/20; A45D 33/22; A45D 33/26; A45D 33/28; A45D 33/30; A45D 34/042; A45D 34/06; A45D 40/00; A45D 40/18; A45D 40/20; A45D 40/24
See application file for complete search history.

(56) References Cited

U.S. PATENT DOCUMENTS 3,132,652 A * 5/1964 Gazdik ..... A45D 33/28 132/297
3,441,033 A * 4/1969 Flax ..... A45D 33/20 132/295
4,936,324 A * 6/1990 Chen ..... A45D 40/22 132/294
5,025,817 A * 6/1991 Wen ..... A45D 33/006 206/823
5,970,989 A 10/1999 Litton
6,619,297 B2 * 9/2003 Sheng ..... A45D 33/20 220/4.27
6,886,695 B1 * 5/2005 Karoly ..... A45D 40/24 206/823
7,389,780 B2 * 6/2008 Byun ..... A45D 33/28 206/379
7,938,268 B1 * 5/2011 Kuo ..... A45D 40/00 132/297
11,832,709 B2 12/2023 Pritchett-El
2002/0108628 A1 * 8/2002 Sheng ..... A45D 33/20 D28/80
2002/0117422 A1 * 8/2002 Karoly ..... A45D 40/24 132/316
2009/0260653 A1 * 10/2009 Ramos ..... A45D 40/24 132/294
2010/0025280 A1 * 2/2010 Palmer ..... B65D 21/0231 206/506
2016/0128447 A1 * 5/2016 Lim ..... A45D 40/18 132/317

(Continued)

*Primary Examiner* — Rachel R Steitz
*Assistant Examiner* — Karim Asqiriba
(74) *Attorney, Agent, or Firm* — Law Office of Sam Sokhansanj PLLC

(57) ABSTRACT

A portable, compact, lightweight, modular, and simple to use cosmetic accessory device that allows users to store and interchange various types of cosmetic applicators and make-up tools on the same device. The portable cosmetic accessory can include a housing having a first end and a second end, a first cover secured to the first end of the housing and a second cover secured to the second end of the housing, and a first pivoting member and a second pivoting member disposed within the housing. In addition, the portable cosmetic accessory can include a first cosmetic applicator and a second cosmetic applicator, wherein the first cosmetic applicator is secured to the first pivoting member and the second cosmetic applicator is secured to the second pivoting member.

13 Claims, 6 Drawing Sheets

(56) References Cited

U.S. PATENT DOCUMENTS

| | | | | |
|---|---|---|---|---|
| 2018/0042360 | A1* | 2/2018 | Gibson | A45D 42/02 |
| 2019/0110579 | A1* | 4/2019 | Piszek | B25H 3/006 |
| 2020/0288840 | A1* | 9/2020 | Al-Sulatieen | A45D 42/00 |
| 2021/0361050 | A1 | 11/2021 | Wilsford | |
| 2021/0393021 | A1* | 12/2021 | Bowers | A45D 40/262 |
| 2023/0200517 | A1* | 6/2023 | Diaz Ordaz Castro | A45D 33/008 132/297 |

* cited by examiner

PORTABLE COSMETIC ACCESSORY

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Many cosmetic products are generally used in combination, such as lipstick and lipliner, mascara and brow products, and the like. Alternatively, many users may wish to mix and match various applicators for cosmetic products, such as applying mascara via an applicator and then using a brush applicator to brush the lashes or eyebrows, among other variations. Given that such applicators are typically sold separately, it can be cumbersome for users to carry all the different types of cosmetic products with them or in their bag. Further, while make-up and cosmetic storage organizer kits and cases are available, they are either generally too large or cumbersome to carry, particularly within a small handbag, purse, clutch, or a pocket.

Hence, what is needed is a portable, compact, lightweight, cost-effective, modular, and simple to use cosmetic accessory device that allows users to store and interchange various types of cosmetic applicators and make-up tools all on the same device.

BRIEF SUMMARY

In one non-limiting exemplary embodiment, a portable, compact, lightweight, cost-effective, modular, and simple to use cosmetic accessory device is disclosed that allows users to store and interchange various types of cosmetic applicators and make-up tools all on the same device. The portable cosmetic accessory can include a housing having a first end and a second end, a first cover secured to the first end of the housing and a second cover secured to the second end of the housing, and a first pivoting member and a second pivoting member disposed within the housing.

In addition, the accessory can include a first cosmetic applicator and a second cosmetic applicator, wherein the first cosmetic applicator is secured to the first pivoting member and the second cosmetic applicator is secured to the second pivoting member.

Further, the first and second pivoting members may each include an opening therein adapted to receive a distal end member of the first and second pivoting members.

Also, the opening may further include a round shape adapted to receive therein a round protruding member of the first or second cosmetic applicator.

In addition, the opening may further include a substantially rectangular shape adapted to receive a substantially rectangular protruding member of the first or second cosmetic applicator.

Moreover, the first cover may house therein a third cosmetic applicator and the second cover houses therein a fourth cosmetic applicator.

Further, the first and second pivoting members may each be adapted to rotate up to 90-degrees about via a hinge member.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
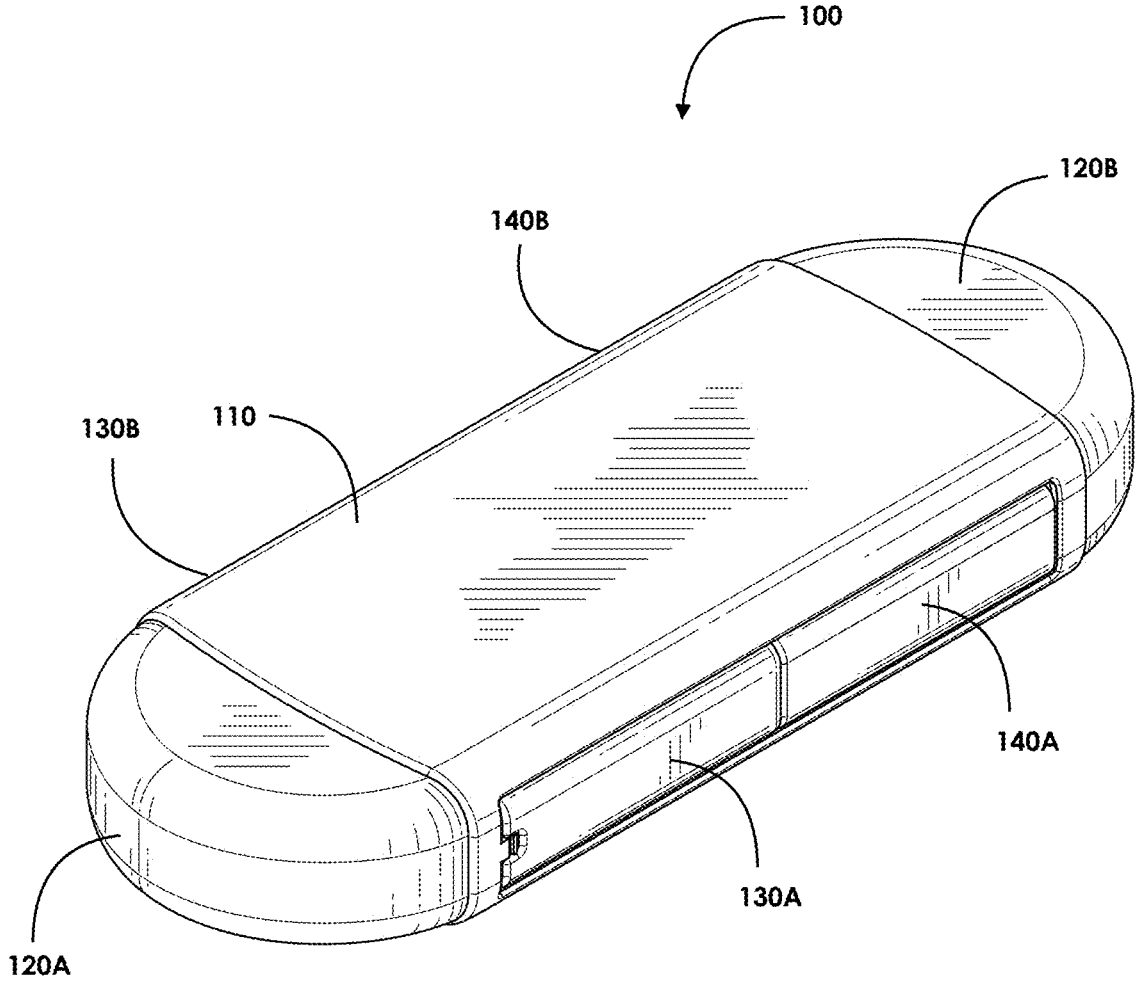
FIG. 1 illustrates a perspective view of the portable cosmetic accessory of the disclosure described herein, according to one non-limiting exemplary embodiment.
Figure 2:
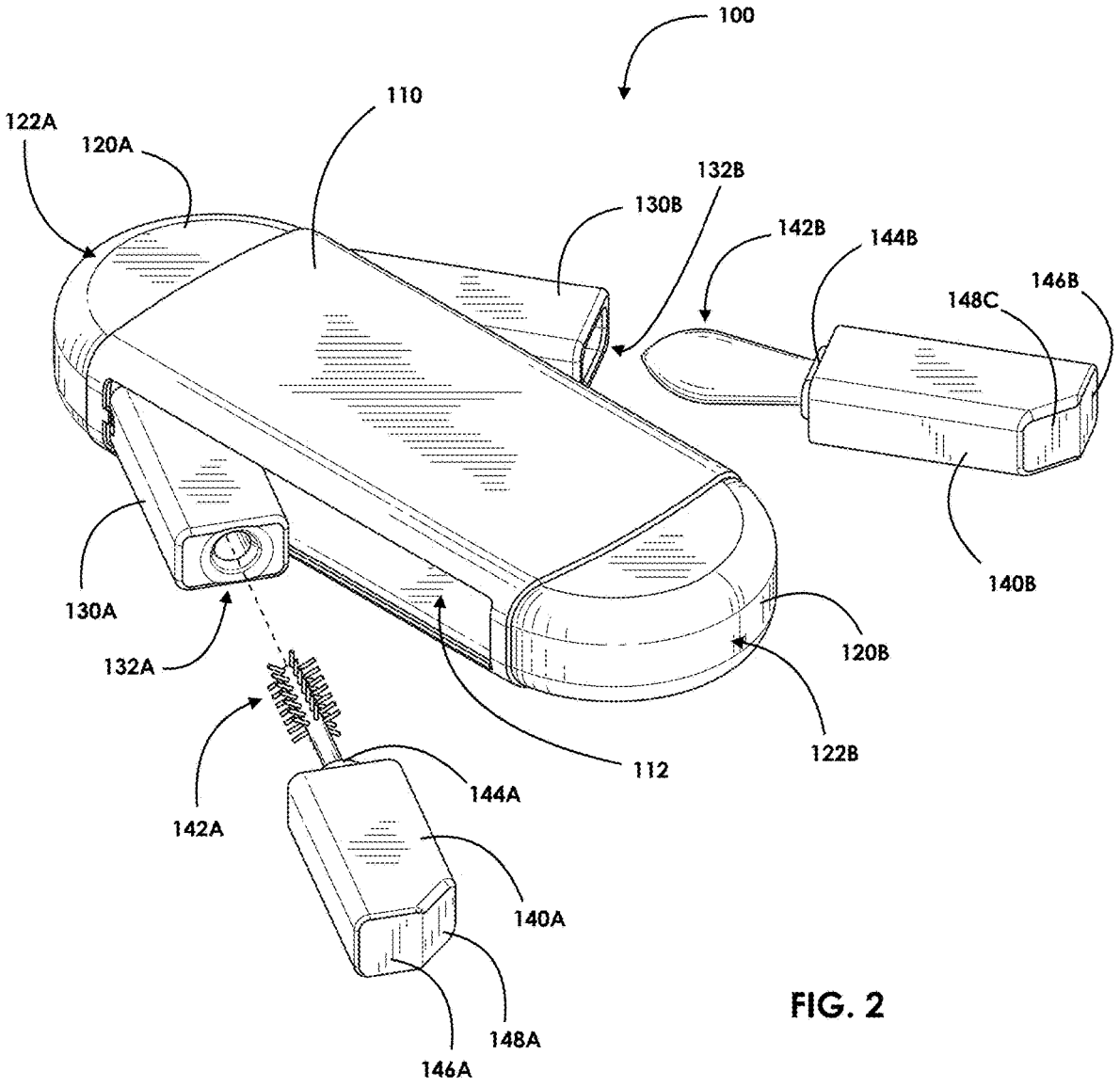
FIG. 2 illustrates another perspective view of the portable cosmetic accessory of FIG. 1.
Figure 3:
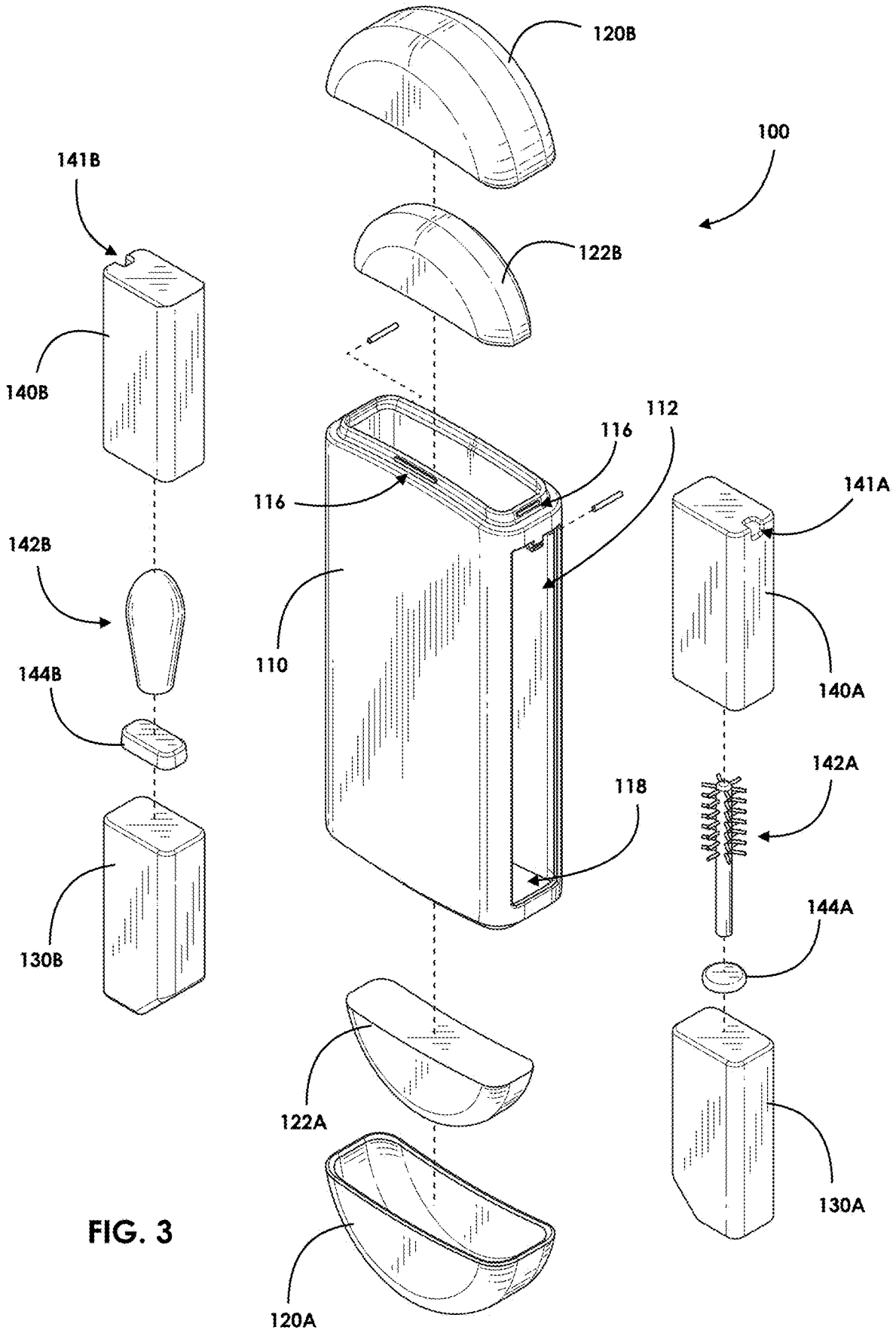
FIG. 3. illustrates an exploded view of the portable cosmetic accessory of FIG. 2.
Figure 4A:
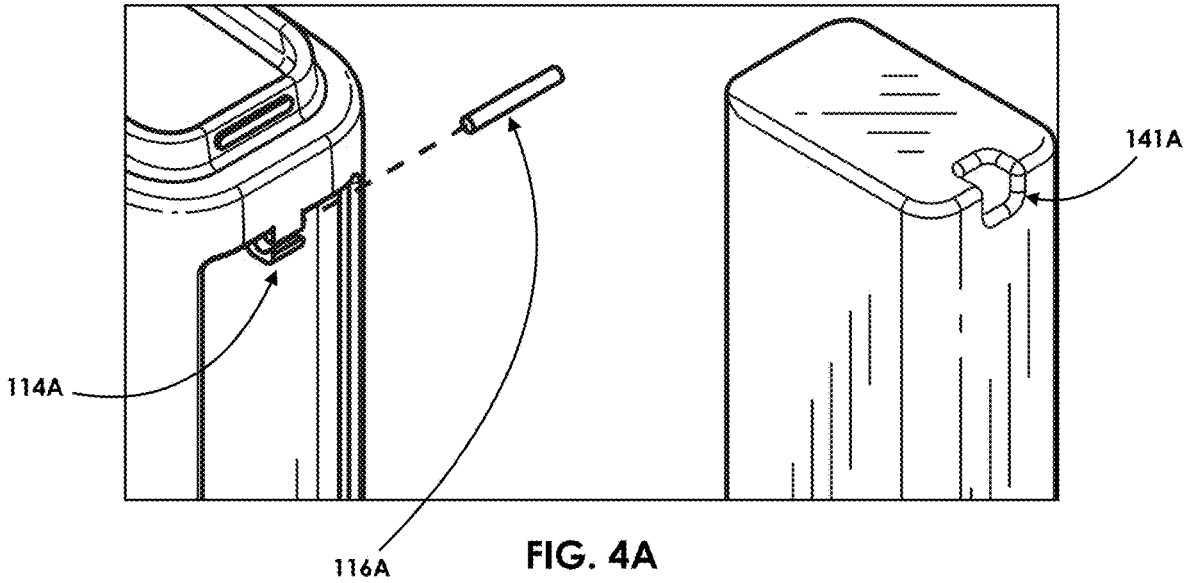
FIG. 4A illustrates a close-up perspective view of the portable cosmetic accessory of FIG. 3.
Figure 4B:
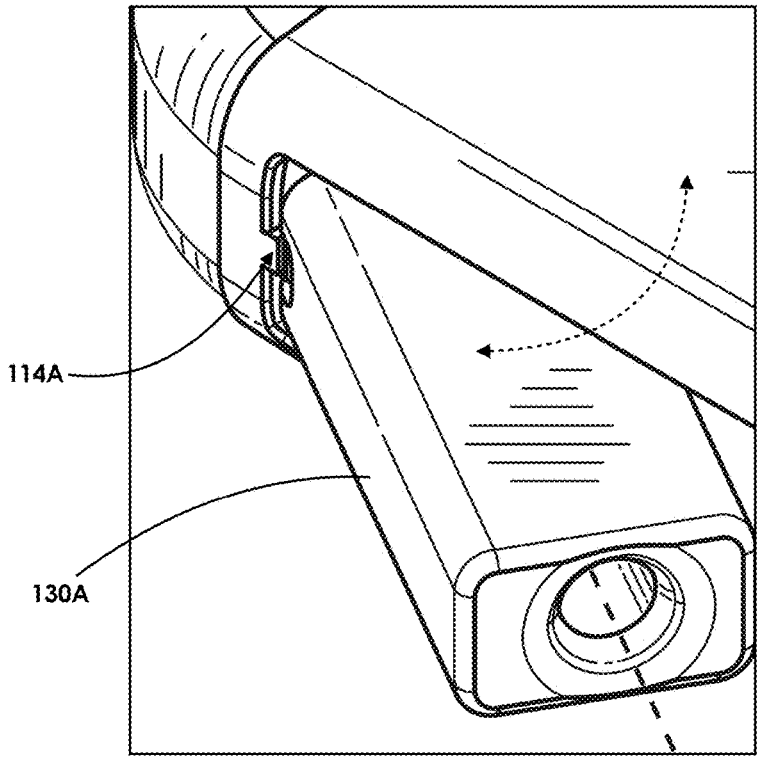
FIG. 4B illustrates another close-up perspective view of the portable cosmetic accessory of FIG. 3.

FIGS. 1-6 illustrates one or more non-limiting exemplary embodiments of the portable cosmetic accessory device 100 of the disclosure described herein. Here, device 100 can include, among others, a body, housing, or casing 110, end caps or covers 120A and 120B, pivoting arm members 130A and 130B, and cosmetic applicators 140A and 140B. Referring to FIGS. 2-3, each end cap 120A and 120B can include an arcuate shape and may house therein cosmetic/make-up related components, tools, or applicators 122A and 122B, respectively, such as face primer, eye primer, eyeliner, concealer, blush, powders, moisturizers, bronzer, eye shadow, foundation, and lipstick, among others. Applicators 122A and 122B are secured to the ends of housing 110. Here, if a user desires to use a particular applicator, such as applicator 122B, then the user can simply remove end cap 120B from housing 110 to expose applicator 122B. Once the user is done using the applicator, then end cap 120B can then be placed or "snapped" back into the top of housing via receptacles or detents 116 engaging end cap 122B to provide a snap-in or friction-fit securement of end cap 122B to housing 110, wherein the same process can be performed with respect to end cap 120A and applicator 122A. It is contemplated within the scope of the present disclosure described herein that applicators 122A and 122B may also be interchanged with other types of applicators.

Referring to FIGS. 1-4B, rotatable or pivoting arm members 130A and 130B can further house and support applicators 140A and 140B, respectively. Here, members 130A and 130B can each include a cut-out or notch 141A and 141B, respectively, wherein each cut-out or notch 141A and 141B can engage a protrusion 114A on housing 110, wherein protrusion 114A further includes therein a tubular bar 116A. In operation, the opposing ends of each bar 116A and each protrusion 114A can 20) be received within notches 141A and 141B, wherein the combination provides a hinge that allows each member 130A and 130B to pivot or rotate about an axis, or about protrusion 114A. In the alternative, protrusion 114A and bar 116A may also be referred to as a hinge assembly. In some embodiments, each member 130A and 130B is adapted to rotate up to 90-degrees, thereby allowing a user to access applicator 140A or 140B (when members 130A or 130B are rotated outwards away from housing 110), and then after use storing the applicators 140A and 140B within members 130A or 130B and pushing the foregoing members back into opening 112 of housing 110, such that applicators 140A and 140B are securely held within housing 110. In other embodiments, the hinge assembly of housing 110 may also be spring actuated and/or include various stops or detents at various pivoting angles of each arm member 130A and 130B. As an example, bar 116A may also be comprised of a spring or biasing member, or in the alternative, operate in combination with a spring or biasing member.

Still referring to FIGS. 1-4B, each applicator 140A and 140B can include various types of distal end members 142A and 142B, such as brushes, bristles, pads, sponges, swabs, or any other applicator, such as face primer, eye primer, concealer, blush, powders, moisturizers, bronzer, eye shadow, eyeliner, foundation, and lipstick, among others among others. Notably, applicators may be interchanged with each other and secured to arm members 130A and 130B and stored within housing 110. In addition, each applicator 140A and 140B can include a protruding member 144A and 144B having a defined shape or configuration that is adapted to be received and secured within a respective opening 132A and 132B of arm members 130A and 130B, respectively. For example, in the current embodiment, opening 132A can be a round shape adapted to receive end member 142A and round protruding member 144A therein, thereby securely engaging and holding applicator 140A at least partially therein. Similarly, opening 132B can be a substantially rectangular shape adapted to receive end member 142B and substantially rectangular protruding member 144B therein, thereby securely engaging and holding applicator 140B at least partially therein. In some embodiments, each applicator 140A and 140B may also "snap" (or via a friction fit) into the openings 132A and 132B of each arm member 130A and 130B, respectively.

Figure 5A:
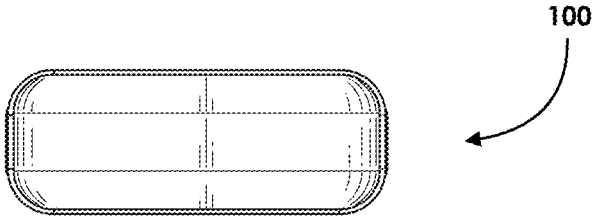
FIG. 5A illustrates a front view of the portable cosmetic accessory of FIG. 1.
Figure 5B:
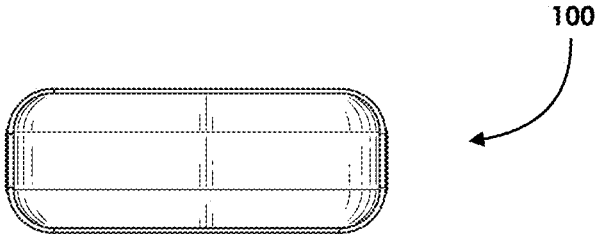
FIG. 5B illustrates a rear view of the portable cosmetic accessory of FIG. 1.
Figure 5C:
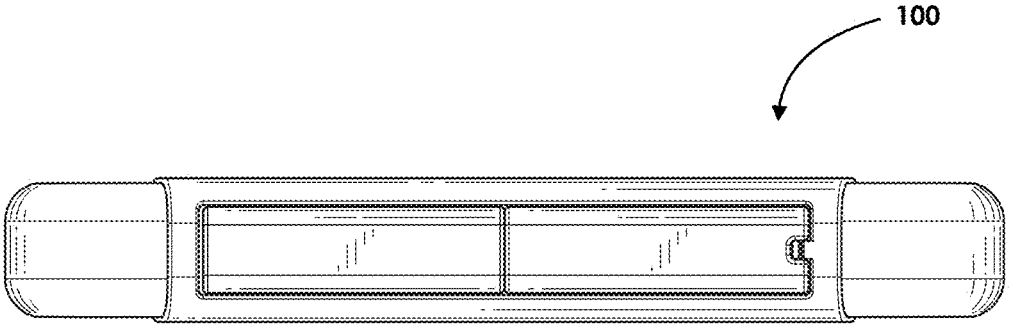
FIG. 5C illustrates a left view of the portable cosmetic accessory of FIG. 1.
Figure 5D:
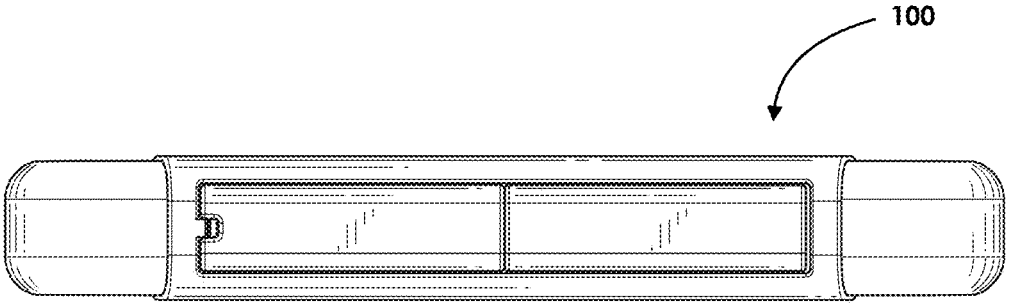
FIG. 5D illustrates a right view of the portable cosmetic accessory of FIG. 1.
Figure 6A:
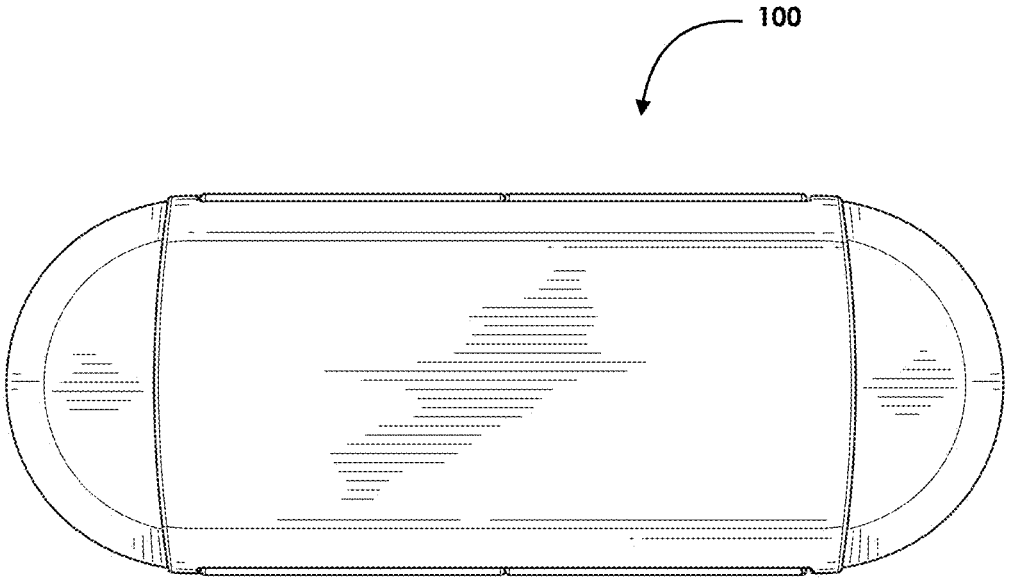
FIG. 6A illustrates a top view of the portable cosmetic accessory of FIG. 1.
Figure 6B:
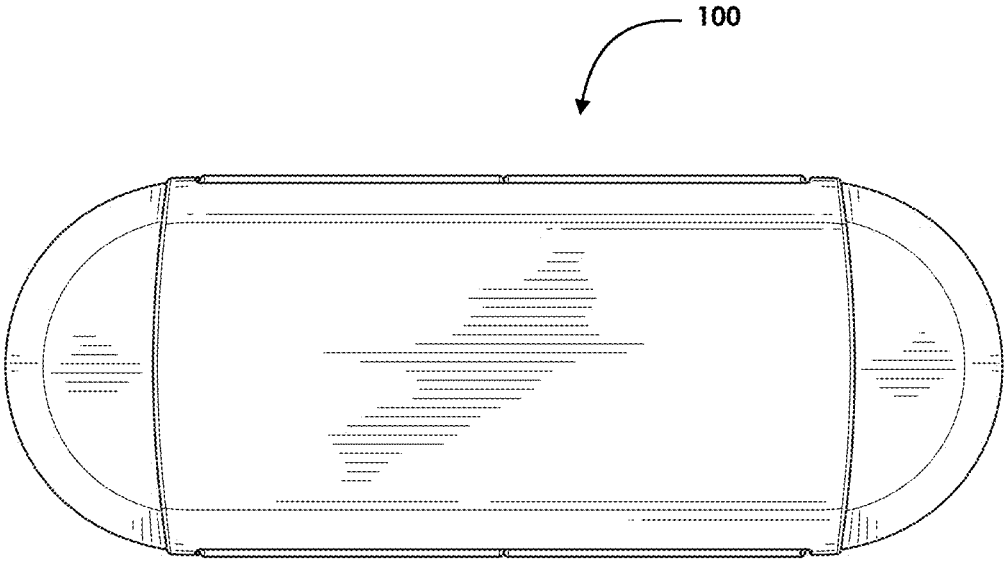
FIG. 6B illustrates a bottom view of the portable cosmetic accessory of FIG. 1.

Referring to FIG. 2, the housing of each applicator 140A and 140B may include a flat top surface area 146A/146B and a sloped surface 148A/148B. In operation, the sloped surfaces 148A and 148B allow the combination of applicators 140A and 140B secured to members 130A and 130B to substantially encompass the length of the opening 112 on each side of housing 110 (or substantially fill-in openings 112), such as shown in FIGS. 5C and 5D. Specifically, despite the combined length of the applicators 140A/140B and members 130A/130B, the sloped surfaces 148A/148B allow a user to be able to rotate or pivot combined applicators 140A/140B and members 130A/130B out of the housing 110 by allowing the proximal end of each applicator 140A/140B to move past surface or wall 118 (FIG. 3) of housing 110, thereby allowing the proximal ends of each applicator 140A/140B to pivot in and out of opening 112 via members 130A/130B without abutting surface 118.

In other embodiments, each arm member 130A or 130B may also include a substance therein that corresponds to end members 142A or 142B of applicators 140A or 140B. For example, in one embodiment, each arm member 130A and 130B may include a nail polish or lacquer solution therein and any of end members 142A or 142B may be comprised of a brush (such that the brush is soaked with the nail polish/lacquer), thereby allowing a user to apply nail polish to their nails via applicators 140A or 140B. In other embodiments, each arm member 130A and 130B may include a cleaning or sanitizing solution for cleaning and/or sanitizing the end members of 142A and 142B of applicators 140A and 140B. In addition, in one embodiment, device 100 may have a length of about 111 mm, a width of about 42 mm, and a height of about 16 mm.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A portable cosmetic accessory, comprising:

a housing comprising a first end and a second end, the housing further comprising a first side opening and a second side opening opposing each other;

a first end cap secured to the first end of the housing and a second end cap secured to the second end of the housing;

a first pivoting member disposed within the first side opening of the housing and a second pivoting member disposed within the second side opening of the housing, wherein the first pivoting member is adapted to at least partially pivot in or out of the first side opening of the housing and the second pivoting member is adapted to at least partially pivot in or out of the second side opening of the housing;

a first cosmetic applicator and a second cosmetic applicator;

wherein the first cosmetic applicator is secured to the first pivoting member and the second cosmetic applicator is secured to the second pivoting member; and wherein the first end cap houses therein a third cosmetic applicator and the second end cap houses therein a fourth cosmetic applicator.

2. The portable cosmetic accessory of claim 1, wherein the first and second pivoting members each comprises an opening therein adapted to receive a distal end member of the first and second cosmetic applicators.

3. The portable cosmetic accessory of claim 2, wherein the opening of the first or second pivoting member is further comprised of a round shape adapted to receive therein a round protruding member of the first or second cosmetic applicator.

4. The portable cosmetic accessory of claim 2, wherein the opening of the first or second pivoting member is further comprised of a substantially rectangular shape adapted to receive a substantially rectangular protruding member of the first or second cosmetic applicator.

5. The portable cosmetic accessory of claim 1, wherein the first and second pivoting members are each adapted to rotate up to 90-degrees via a hinge member.

6. A portable cosmetic accessory, comprising:

a housing comprising a first end, a second end, a top surface, and a bottom surface;

the housing further comprising a first side opening and a second side opening opposing each other;

a first cover secured to the first end of the housing and a second cover secured to the second end of the housing, wherein the first and second covers each comprise an arcuate configuration;

a first pivoting member at least partially secured within the first side opening of the housing and a second pivoting member at least partially secured within the second side opening of the housing, wherein the first pivoting member and the second pivoting member are each adapted to rotate in a plane parallel to a plane of the top and bottom surface of the housing;

a first cosmetic applicator and a second cosmetic applicator;

wherein the first cosmetic applicator is secured to the first pivoting member and the second cosmetic applicator is secured to the second pivoting member; and wherein the first cover covers a third cosmetic applicator and the second cover covers a fourth cosmetic applicator.

7. The portable cosmetic accessory of claim 6, wherein the first and second pivoting members each comprise an opening therein adapted to receive a distal end member of the first and second cosmetic applicators.

8. The portable cosmetic accessory of claim 7, wherein the opening of the first or second pivoting member is further comprised of a round shape adapted to receive therein a round protruding member of the first or second cosmetic applicator.

9. The portable cosmetic accessory of claim 7, wherein the opening of the first or second pivoting member is further comprised of a substantially rectangular shape adapted to receive a substantially rectangular protruding member of the first or second cosmetic applicator.

10. The portable cosmetic accessory of claim 6, wherein the first and second pivoting members are each adapted to rotate up to 90-degrees via a hinge member.

11. A portable cosmetic accessory, comprising:

a housing comprising a first end, a second end, a top surface, and a bottom surface, wherein the top and bottom surface are each within a horizontal plane;

the housing further comprising a first side opening and a second side opening;

a first end cap secured to the first end of the housing and a second end cap secured to the second end of the housing;

a first pivoting member at least partially secured within the first side opening of the housing and a second pivoting member at least partially secured within the second side opening of the housing, wherein the first pivoting member and the second pivoting member are each adapted to rotate within a horizontal plane parallel to the horizontal plane of the top and bottom surface of the housing;

a first cosmetic applicator and a second cosmetic applicator;

wherein the first cosmetic applicator is secured to the first pivoting member and the second cosmetic applicator is secured to the second pivoting member; and wherein the first end cap covers a third cosmetic applicator and the second end cap covers a fourth cosmetic applicator.

12. The portable cosmetic accessory of claim 11, further comprising:

wherein the first side opening comprises a first hinge member adapted to support the first pivoting member and the second side opening comprises a second hinge member adapted to support the second pivoting member.

13. The portable cosmetic accessory of claim 11, wherein the first and second cosmetic applicators each comprise a slanted proximal end.

* * * * *